United States Patent [19]

Gut et al.

[11] 4,380,492

[45] Apr. 19, 1983

[54] METHOD OF USING A CHISEL FOR A CRUST BREAKING FACILITY

[75] Inventors: Edwin Gut, Steg; Erwin Arnold, Venthône; Hans Friedli, Steg, all of Switzerland

[73] Assignee: Swiss Aluminium Ltd., Chippis, Switzerland

[21] Appl. No.: 323,021

[22] Filed: Nov. 19, 1981

Related U.S. Application Data

[63] Continuation of Ser. No. 184,343, Sep. 5, 1980, Pat. No. 4,317,595.

[30] Foreign Application Priority Data

Sep. 10, 1979 [CH] Switzerland ..... 8151/79

[51] Int. Cl.[3] ..... C25C 3/06; C25C 3/14; C25C 15/08

[52] U.S. Cl. ..... 204/67

[58] Field of Search ..... 204/67, 245, 279; 175/390, 407; 299/53, 94

[56] References Cited

U.S. PATENT DOCUMENTS 3,551,308 12/1970 Capitaine et al. ..... 204/67

*Primary Examiner*—Howard S. Williams

*Attorney, Agent, or Firm*—Bachman and LaPointe

[57] ABSTRACT

Device and method for breaking open the solidified crust of electrolyte on an electrolytic cell, in particular a cell for producing aluminum. At least one projection is provided on the lower part of the shaft of a chisel used on a crust breaker. After breaking through the crust, the chisel is lowered further at least until the lowest projection or projections reaches the lower half of the crust.

11 Claims, 5 Drawing Figures

METHOD OF USING A CHISEL FOR A CRUST BREAKING FACILITY

CROSS-REFERENCE TO RELATED APPLICATIONS

This application is a Continuation of U.S. patent application Ser. No. 184,343, filed Sept. 5, 1980, now U.S. Pat. No. 4,317,595.

BACKGROUND OF THE INVENTION

The invention relates to a chisel for a facility for breaking open the solidified crust on an electrolytic cell, in particular on a cell for producing aluminum, and a method for using the chisel in practice.

In the manufacture of aluminum from aluminum oxide the latter is dissolved in a fluoride melt made up for the greater part of cryolite. The aluminum which separates out at the cathode collects under the fluoride melt on the carbon floor of the cell; the surface of this liquid aluminum acts as the cathode. Dipping into the melt from above are anodes which, in the conventional reduction process, are made of amorphous carbon. As a result of the electrolytic decomposition of the aluminum oxide, oxygen is produced at the carbon anodes; this oxygen combines with the carbon in the anodes to form $CO_2$ and CO. The electrolytic process takes place in a temperature range of approximately 940°–970° C.

The concentration of aluminum oxide decreases in the course of the process. At an $Al_2O_3$ concentration of 1–2 wt.% the so-called anode effect occurs producing an increase in voltage from e.g. 4–4.5 V to 30 V and more. Then at the latest the crust must be broken open and the concentration of aluminum oxide increased by adding more alumina to the cell.

Under normal operating conditions the cell is fed with aluminum oxide regularly, even when no anode effect occurs. Also, whenever the anode effect occurs the crust must be broken open and the alumina concentration increased by the addition of more aluminum oxide, which is called servicing the cell.

For many years now servicing the cell includes breaking open the crust of solidified melt between the anodes and the side ledge of the cell, and then adding fresh aluminum oxide. This process which is still widely practiced today is finding increasing criticism because of the pollution of the air in the pot room and the air outside. In recent years therefore it has become increasingly necessary and obligatory to hood over or encapsulate the reduction cells and to treat the exhaust gases. It is however not possible to capture completely all the exhaust gases by hooding the cells if the cells are serviced in the classical manner between the anodes and the side ledge of the cells.

More recently therefore aluminum producers have been going over to servicing at the longitudinal axis of the cell. After breaking open the crust, the alumina is fed to the cell either locally and continuously according to the point feeder principle or discontinuously along the whole of the central axis of the cell. In both cases a storage bunker for alumina is provided above the cell. The same applies for the transverse cell feeding proposed recently in U.S. Pat. No. 4,172,018.

The breaking open of the solidified electrolyte is carried out with conventional, well known devices fitted with chisels which are rectangular or round in cross section.

The under part of the chisel which comes into immediate contact with the solidified electrolyte when breaking through the crust is, in the case of the known devices, e.g. vertical to the sidewalls, or is in the form of a cone or blunted cone on the face vertical to the sidewalls of the chisel. In U.S. patent application Ser. No. 184,480, filed Sept. 5, 1980, now abandoned, a chisel shape providing a stamping or shearing action is described.

When using permanently installed crust breaking facilities an opening of close fit for the chisel is created in the crust as a result of the repeated servicing at relatively short intervals and previous operation of the chisel, i.e. only a very small space exists between the chisel and the crust which is broken open. Depending on the shape of the crust breaker, in particular the chisel, there is a greater or lesser risk of the chisel becoming jammed in this opening in the crust.

SUMMARY OF THE INVENTION

It is therefore an object of the invention to develop a device for breaking open the crust on an electrolytic cell and a method for its operation which ensures continuous operation without it jamming.

This object is achieved by way of the device according to the invention in that at least one projection is provided in the lower region of the vertical sidewalls of the chisel.

Such a projection is usefully of an elongated shape and extends, horizontally positioned, over at least a part of the periphery of the chisel. However, two or more projections can also be provided in parallel plane; their distance from the under side of the chisel and the distance between each other can be varied according to the geometry of the cell.

The projections are preferably made of the same material as the chisel, in particular a hard, weldable steel e.g. St 45–50. Pre-shaped projections can be mounted on the vertical sidewalls of the chisel by suitable methods of fixing e.g. welding or bolting. The projections can also be in the form of weld seams which are finished off by a suitable finishing process. The chisel and projections can be in one piece by e.g. machining the chisel to the appropriate shape. In general the projections are rectangular in cross section; a square shape is preferred, and they are often slightly undercut on the lower side.

The dimensions of the projection are important: a projection which stands out too far from the chisel is in danger of being deformed; if it stands out too little then it will be ineffective. A distance of 5–15 mm is therefore preferred. That is, as clearly shown in the drawings, the chisel has a cross-sectional dimension and all surfaces of said projections extend outwardly substantially less than said cross-sectional dimension.

The solution according to the invention, taking into account the process in mind, is such that the chisel, with at least one projection in the lower region of its sidewalls, after breaking through the crust, is lowered further at least until the lowest projection reaches the lower half (in terms of its thickness) of the crust.

On pressing the projections into the solidified electrolyte, the same create a gap, which prevents the chisel forming an opening which is a close fit for the chisel. If it is desired that the projections push completely through the crust when the chisel is lowered, then these are positioned far down the chisel sidewalls i.e. near the working face of the chisel. If on the other hand the projections are required to break through only the upper half of the crust, they are mounted correspondingly further up the chisel walls. It is in fact possible to position these projections even further from the working end i.e. further up; this is however of little value as the following advantages will not or will only partially be realized as the chisel is lowered the next time viz., that:

the chisel does not jam in the crust the chisel can be withdrawn without difficulty the forces on the piston rod arrangement can be reduced.

The crust breaker facility which in principle comprises a pressure cylinder, piston rod and chisel is mounted directly or indirectly on the superstructure of the cell or is a component part of a cell servicing vehicle or manipulator.

BRIEF DESCRIPTION OF THE DRAWINGS

Exemplified embodiments of the invention are described in the following with the help of schematic drawings viz.

DETAILED DESCRIPTION

Figure 1:
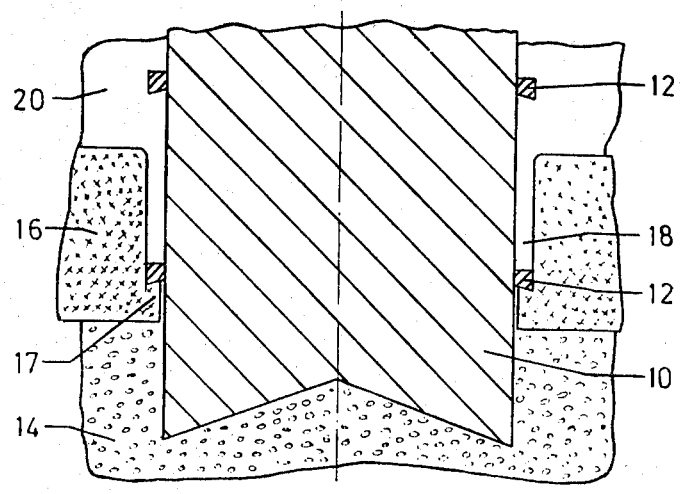
FIG. 1: A longitudinal section through a chisel which is rectangular in cross section and features projections on its narrow edges, shown here in the lowest working position.
Figure 2:
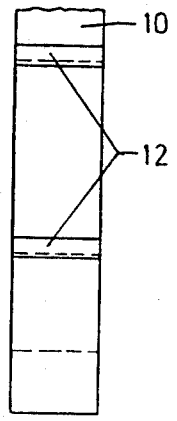
FIG. 2: An end view of the chisel shown in FIG. 1.

FIG. 1 shows a chisel which is an elongated rectangle in cross section, 150×140 mm in the case in question. The lower part of the chisel 10 is immersed in the melt 14 i.e. it has completely penetrated the solidified melt 16. This lower part is shown here to be fish-tailed in shape. Although this shape is of advantage, the lower part of the chisel can have any suitable shape.

The lower pair of projections 12 on the narrow side has almost completely penetrated the crust. As a result an almost complete and continuous gap 18 has been created between the chisel 10 and the crust. As shown in FIG. 1, alumina 20 lying on the crust 16 is trickling down this gap. This does not cause the chisel 10 to jam, therefore the chisel 10 can readily be withdrawn after penetrating the crust 16. When the cell is serviced again, which with the automatic systems takes place after a brief interval, the chisel can be introduced without any difficulty into the spacious hole created by the projections. If the chisel is not exactly centered, it pushes away the residual nose 17 of solidified crust 16 left over from the previous servicing of the cell, and does so without difficulty or any great force.

In embodiments of the invention not illustrated here further projections can be provided on the broad face of the chisel.

Furthermore, the chisel can also be pushed down further so that the lower pair of projections 12 penetrate the crust completely.

The sidewall of the projections (which are about 1 $cm^2$ in cross section) facing the bath or the side of the chisel is undercut, preferably at an angle of up to 20° as clearly shown in FIG. 1. This working face which is inclined upwards towards the chisel causes the projections to act like teeth.

The alumina and the pieces of crust broken off by the lower face of the chisel which are pushed into the molten electrolyte 14 are omitted here for the sake of clarity in the figure.

Figure 3:
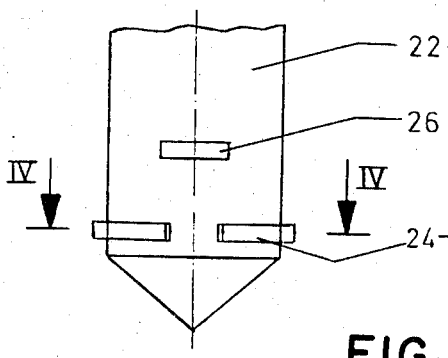
FIG. 3: A view of a chisel which is round in cross section and which features two pairs of projections at different levels and displaced around the circumference with respect to each other.
Figure 4:
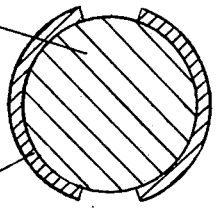
FIG. 4: A cross section along IV—IV of the chisel shown in FIG. 3.

FIGS. 3 and 4 show a chisel 22 which is round in cross section. In this case too it should be readily apparent that the lower part of the chisel, which is conical here, can have any other suitable form.

A lower pair of projections 24 extends around the greater part of the periphery of the chisel; this can be seen particularly well in FIG. 4 which is a horizontal section of the chisel shown in FIG. 3. Another pair of projections 26 further up the shaft of the chisel on the other hand extend around a relatively small part of the circumference.

Figure 5:
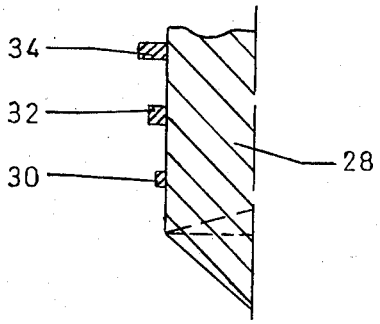
FIG. 5: A longitudinal cross section through part of a chisel with projections of various sizes.

Whereas the projections shown in FIGS. 1–4 are characterized not only by their longish shape and their horizontal position, but also by their uniform width, FIG. 5 shows a part of a longitudinal view through a chisel which has projections of various widths. The lowest projection 30, which acts first on the solidified electrolyte, is narrow, and the uppermost projection 34 is the widest. This means that when the crust breaker is put into action, the space created between the chisel and the crust is enlarged in stages from the bottom to the top.

It is understood of course that the projections according to the invention secured to the lower region of the chisel can have many different forms and achieve the same result. The lowest part of the chisel bearing or forming the projections can be in the form of an exchangeable part which is releasably connected to the shaft of the chisel. This version has the advantage that after a certain degree of wear or when repair is called for, only the lowest part and not the whole chisel need be changed.

What is claimed is:

1. Process for breaking the solidified crust on an electrolytic cell by operating a crust breaker fitted with a chisel which comprises providing a chisel having a cross-sectional dimension and having a vertical sidewall with at least one small, substantially horizontally extending projection in the lower region of the vertical sidewall, wherein all surfaces of said projections extend outwardly substantially less than said cross-sectional dimension, penetrating the crust with said chisel, lowering said chisel further at least until the lowest projection or projections reaches the lower half of the crust to enable continuous operation without jamming, without projection deformation and with reduced force.

2. Process according to claim 1 wherein the chisel is lowered further at least until the lowest projection or projections are pushed completely through the crust.

3. Process according to claim 1 for breaking the solidified crust on an electrolytic cell for producing aluminum.

4. Process according to claim 1 wherein the projections extend around at least a part of the chisel periphery and are rectangular in cross section.

5. Process according to claim 1 wherein the projections extend out 5–15 mm from the sidewall of the chisel.

6. Process according to claim 1 wherein the face of the projection facing the lower part of the chisel is undercut.

7. Process according to claim 6 wherein said face is undercut at an angle of up to 20°.

8. Process according to claim 1 wherein a plurality of projections on different planes on the chisel sidewall project out equal distances from the sidewall.

9. Process according to claim 1 wherein a plurality of projections on different planes on the chisel sidewall project out from said sidewall by distances which increase from the bottom of the chisel.

10. Process according to claim 1 wherein said projections are of an elongated shape and extend horizontally from the vertical sidewall of the chisel and over at least a part of the periphery of the chisel.

11. Process for breaking the solidified crust on an electrolytic cell by operating a crust breaker fitted with a chisel which comprises providing a chisel having a cross-sectional dimension and having a vertical sidewall with at least one projection in the lower region of the vertical sidewall, wherein all surfaces of said projections extend outwardly substantially less than said cross-sectional dimension to minimize the danger of deformation, wherein said surfaces extend outwardly a sufficient distance to avoid jamming, penetrating the crust with said chisel, lowering said chisel further at least until the lowest projection or projections reaches the lower half of the crust, whereby a gap is created in the solidified crust which prevents the chisel forming an opening which is a close fit for the chisel.

* * * * *